United States Patent [19]

Svoboda

[11] Patent Number: 4,634,194

[45] Date of Patent: Jan. 6, 1987

[54] CABINET WITH ROLL FRONT TO BE OPENED IN THE UPWARD DIRECTION

[76] Inventor: Johann Svoboda, Purkersdorfer Strasse 58, A-3100 St. Polten, Austria

[21] Appl. No.: 761,710

[22] Filed: Aug. 2, 1985

[51] Int. Cl.[4] ..... A47B 96/20

[52] U.S. Cl. ..... 312/297; 160/191; 160/192; 160/201

[58] Field of Search ..... 312/297; 160/191, 192, 160/201, 265, 32, 33

[56] References Cited

U.S. PATENT DOCUMENTS

| | | | |
|---|---|---|---|
| 1,548,396 | 8/1925 | Tavernier | 160/265 |
| 2,334,749 | 11/1943 | Burr | 160/192 |
| 3,532,153 | 10/1970 | D'Anka | 312/297 |

FOREIGN PATENT DOCUMENTS

| | | | |
|---|---|---|---|
| 208542 | 8/1958 | Austria | 312/297 |

*Primary Examiner*—William E. Lyddane
*Assistant Examiner*—Joseph Falk
*Attorney, Agent, or Firm*—Young & Thompson

[57] ABSTRACT

A cabinet comprises a cabinet frame (2) and a roll front (1) to be opened in the upward direction. At least two springs (6, 7, 8, 9) engage at the roll front (1), these springs being attached with their other ends at the cabinet frame and having mutually different spring characteristics and/or different tension. The sum total of the forces exerted by the springs (6, 7, 8, 9) on the roll front (1) compensates, in any position of the roll front (1), essentially the weight of the latter.

4 Claims, 10 Drawing Figures

CABINET WITH ROLL FRONT TO BE OPENED IN THE UPWARD DIRECTION

The invention relates to a cabinet with a roll front to be opened in the upward direction and with springs, each of which engages the cabinet frame, on the one hand, and the roll front, on the other hand.

Such cabinets are known, for example, from Austrian Patent No. 208,542 or U.S. Pat. No. 3,532,153.

In the conventional cabinets, the springs mounted, on the one hand, to the cabinet frame and, on the other hand, to the roll front, act respectively in a single direction. It has now been found that the conventional array of springs, practically effective as a single spring, makes it impossible to provide complete and accurate compensation of the roll front weight since the spring bias of the spring elements cannot be adequately synchronized in correspondence with the weight and/or cantilever weight prevailing in dependence on the opening position of the roll front. This is so because the elasticity curve or the tensioning force of a spring, or other elastic elements, acting only in one direction cannot be adequately adapted to the requirements of a balanced weight equalization for roll fronts.

The invention is based on the object of further improving the known cabinet toward the objective of compensating the weight of the roll front in any position of the latter.

This is attained according to the invention by providing that at least two springs acting in mutually opposed directions, having spring characteristics different from each other and/or differing tension, engage at the roll front wherein, between the completely open and the completely closed positions of the roll front, the force of at least one spring, preferably however of two springs, acts in the upward direction, and the force of at least one further spring, but preferably two springs, acts in the downward direction.

By the use, according to this invention, of several springs having differing spring characteristics, which can be obtained by differing spring properties and/or a differing tension of the various springs, it is possible to render the roll front practically weightless so that merely the friction forces have to be overcome for opening and closing. Suitable springs within the scope of this invention are springs of rubber, synthetic resins, or metal in the form of elastic cords, coil springs or spiral springs.

Due to the feature that the springs engaging at the roll front act in mutually opposite directions, for example upwardly and downwardly, respectively, it is possible to absorb the weight of the closed roll front by the downwardly acting springs, and the weight of the opened roll front by the downwardly acting springs.

It is furthermore advantageous in the cabinet of this invention that at least two upwardly acting and two downwardly acting springs engage the roll front. Here again, it is possible to utilize springs having differing spring properties and/or different tension, respectively acting in the same direction. Thus, for example, respectively two upwardly acting and two downwardly acting springs are provided, of which spring pairs respectively one spring is softer and the other is harder.

According to one embodiment of the invention, the provision is made that, in the completely open and/or in the completely closed position of the roll front, respectively at least one of the springs is tensioned and respectively at least one of the springs is relaxed. This embodiment affords the advantage that the springs not required for weight compensation are completely relaxed and therefore do not exert any forces whatever on the roll front.

Another feature of the invention resides in that, with the roll front being approximately half open, the sum total of the upwardly and of the downwardly acting forces of the springs equals zero.

According to a further embodiment of the invention, the provision can be made that at least one mounting point of the springs is displaceable along the cabinet frame within limits. In this embodiment, a means of control is created for tensioning the respective spring only after a certain displacement path of the roll front, which can be utilized advantageously for weight compensation. Under practical conditions, an embodiment has proven itself well in this connection wherein at least one of the mounting points for the springs at the cabinet frame is slidably guided in guide rails exhibiting optionally adjustable stops for limiting the displaceability of the mounting points; or an embodiment which is distinguished in that at least one of the mounting points is arranged at the free end of a lever that can be swung about a predetermined angular range.

The provision can be made within the scope of this invention, on the one hand in order to be able to install relatively long springs and on the other hand to design the spring characteristics of these springs to be different in different directions, that at least one of the springs is guided by an eye or the like affixed to the cabinet frame, between its mounting points at the cabinet frame and at the roll front.

Finally, the provision can be made according to the invention that the mounting points of the springs at the roll front are arranged outside of the center of the roll front, preferably in the half of the roll front facing the mounting point of the respective spring at the cabinet frame. By this choice of mounting points, the roll front is uniformly stressed so that the roll front does not tend to seize in the cabinet frame.

Additional details of the invention can be seen from the following description of the embodiment illustrated schematically in the drawing wherein.

Figure 1:
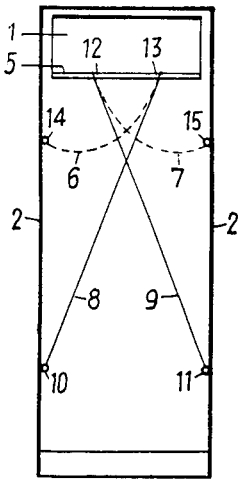
FIG. 1 shows, in a rear view, a cabinet with the roll front being closed.
Figure 2:
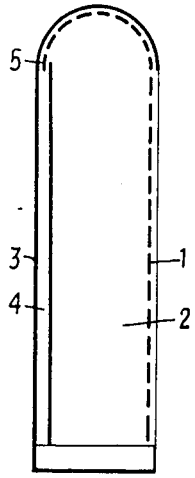
FIG. 2 shows a lateral view in connection with FIG. 1.
Figure 9:
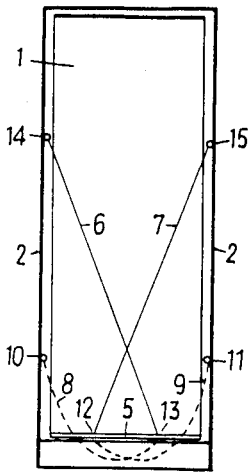
FIG. 9 shows, in a rear view, the cabinet with the roll front completely opened.
Figure 10:
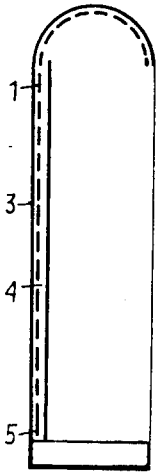
FIG. 10 shows the lateral view thereof.

A roll front 1 is guided in grooves, not shown, in a cabinet frame 2 with side faces, and can be shifted, from the closed position shown in FIGS. 1 and 2, gradually up into the completely opened position illustrated in FIGS. 9 and 10.

During this procedure, the roll front 1 is inserted, namely in a housing 4 provided in the zone of the rear wall 3.

For weight compensation of the roll front 1, several springs are provided attached, on the one hand, at the end 5 of the roll front 1 that is at the top, i.e. in the region of the rear wall 3, in the closed position (FIGS. 1 and 2) and, on the other hand, at the cabinet frame 2, in the shown example at the side faces. The springs 6 and 7 act upwardly and the springs 8 and 9 act downwardly.

It can be seen that, in the closed position of the roll front 1 (FIGS. 1 and 2), exclusively the springs 8 and 9 are utilized for weight balancing. For this purpose, the springs 8 and 9 are tensioned between the mounting points 10 and 11 affixed to the cabinet frame and the mounting points 12 and 13 at the roll front 1.

In the closed position of the roll front 1, the springs 6 and 7, fastened to the mounting points 12 and 13 and the mounting points 14 and 15, are relaxed and sag loosely, as shown in FIG. 1. If, now, the roll front 1 is opened, then the springs 8 and 9 compensate the weight of the roll front which decreases with progressive opening, the weight of the roll front 1 being decreased because an increasing portion thereof is suspended into the housing 4 in the zone of the rear wall 3, and the portion of the roll front 1 arranged in the zone of the front face of the cabinet becomes shorter.

Figure 3:
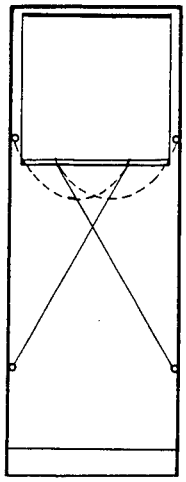
FIGS. 3–8 show, respectively in rear views and lateral views, the cabinet of FIG. 1 with an increasingly opened roll front.
Figure 4:
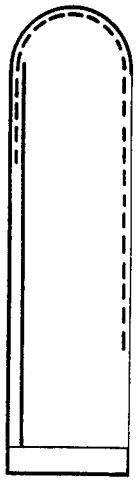
Figure 5:
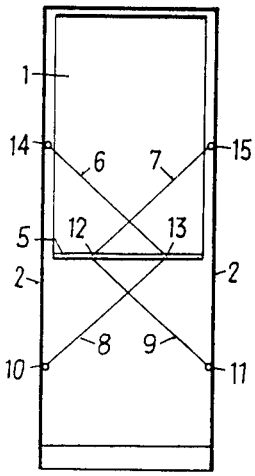
Figure 6:
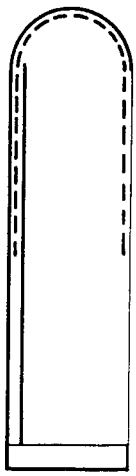
Figure 7:
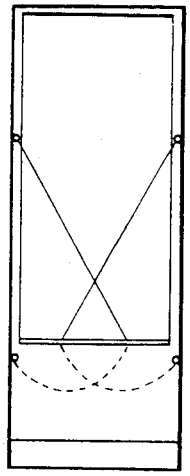
Figure 8:
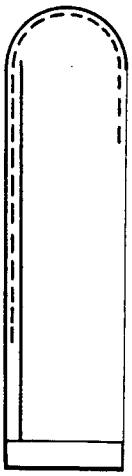

Following the position shown in FIGS. 3 and 4, opened to the extent of one quarter, the position according to FIGS. 5 and 6 is finally reached, wherein the roll front 1 is half open and the portions of the roll front 1 located in the region of the front face of the cabinet and of the rear wall 3 are of equal length. It can be seen that, in this case, the two spring pairs 6, 7 and 8, 9, respectively, are uniformly tensioned so that the resultant spring forces are equal to zero.

With progressive opening, the springs 6 and 7 are additionally tensioned and compensate, on account of their action in the upward direction, the weight of the roll front 1, whereas the springs 8 and 9 are now relaxed.

According to one embodiment of the cabinet, not shown, it is possible to design the springs 6 and 7 or 8 and 9 to be different. Thus, for example, the spring 6 can exhibit a different elasticity and/or different spring characteristics from those of the spring 7. However, it is also possible, for example, for the springs 8 and 9 to be identical and to differ with respect to their spring properties from springs 6 and 7.

It is furthermore possible within the scope of this invention to make the mounting points 10, 11 and/or 14,15 of the springs 6, 7, 8 and 9 at the cabinet frame 2 to be displaceable within limits. This displaceability, which normally will be a vertical displaceability, can be attained by accommodating the mounting points in guide rails, stops being provided in the guide rails for limiting the displaceability of the mounting points. If the stops are selected to be movable, it is additionally possible to adjust the clearance of movement of the mounting points to the desired extent.

Another possibility for designing the mounting points 10, 11 and/or 14, 15 to be movable is to arrange them at the free ends of levers that can be swung to and fro.

Not all of the springs provided in the cabinet must exhibit movable mounting points. Rather, it is also possible that only individual springs, or a single one of the springs, has a movable mounting point.

What is claimed is:

1. A cabinet with a roll front to be opened in the upward direction, the roll front having a completely closed position in which most of the roll front is disposed from top to bottom of the cabinet along the front of the cabinet and a completely open position in which most of the roll front is disposed from top to bottom of the cabinet along the rear of the cabinet, first tension spring means interconnecting the roll front and the cabinet and so disposed along the path of movement of the roll front as to resist movement of the roll front to a said completely open position, and second spring means interconnecting the roll front and the cabinet and so disposed as to resist movement of the roll front to said fully closed position, said first spring means being connected to the cabinet at a location spaced a substantial distance from the location at which said second spring means is connected to the cabinet, in the direction of closing movement of the cabinet.

2. A cabinet as claimed in claim 9, in which said first spring means is fully relaxed in the fully closed position of the roll front and said second spring means is fully relaxed in the fully open position of the roll front.

3. A cabinet as claimed in claim 9, in which the forces applied by said first and second spring means on said roll front are equal and opposite when said roll front is about half open.

4. A cabinet as claimed in claim 9, in which each of said spring means comprises a pair of elongated tension springs secured at one end to opposite sides of the cabinet and crossing each other before terminating at their other ends in points of securement to the roll front that are laterally spaced apart.

* * * * *